United States Patent [19]

Kutik et al.

[11] 4,231,493

[45] Nov. 4, 1980

[54] LEVER PUMP WITH BUTTON ACTUATOR

[75] Inventors: Louis F. Kutik, Fort Lauderdale; Howard E. Cecil, Miramar, both of Fla.

[73] Assignee: Security Plastics Inc., Miami Lakes, Fla.

[21] Appl. No.: 28,961

[22] Filed: Apr. 11, 1979

[51] Int. Cl.[3] ..... B05B 11/00

[52] U.S. Cl. ..... 222/321; 222/340; 222/380; 222/505

[58] Field of Search ..... 222/259, 321, 340, 380, 222/382, 385, 189, 464, 505, 509, 402.15; 239/329, 331, 333, 575, 590.3; 417/541

[56] References Cited

U.S. PATENT DOCUMENTS

| | | | |
|---|---|---|---|
| 2,521,882 | 9/1950 | Swift et al. | 222/340 |
| 2,691,548 | 10/1954 | Feucht et al. | 222/402.15 X |
| 2,830,745 | 4/1958 | Aicart | 222/402.15 X |
| 4,138,039 | 2/1979 | Micallef | 222/321 |
| 4,146,155 | 3/1979 | Kutik et al. | 222/189 X |

*Primary Examiner*—Robert J. Spar
*Assistant Examiner*—Frederick R. Handren
*Attorney, Agent, or Firm*—Oltman and Flynn

[57] ABSTRACT

A pumping system is provided in which actuation of a piston and cylinder device is provided by a combination of a button and a lever. The lever magnifies the force applied to the button so that the pumping system operates at high pressure when pumping liquid product. On the other hand, when pumping air in priming the pump, the pumping system operates at very low pressure so that air can escape from the pump easily to aid in priming the pump.

14 Claims, 10 Drawing Figures

LEVER PUMP WITH BUTTON ACTUATOR

RELATED PATENTS

This application is related to U.S. Pat. No. 4,079,865 of Louis F. Kutik and also to U.S. Patent Application Ser. No. 974,328 filed on Dec. 29, 1978 by Louis F. Kutik and Howard E. Cecil.

BACKGROUND OF THE INVENTION

The aforementioned patent and patent application disclose and claim a pumping system in which a quantity of pressurized product is stored in a storage compartment during a pressurizing stroke and discharged through an outlet orifice during a succeeding intake stroke to maintain a stream or spray issuing from the system. The patent application is particularly concerned with a trigger pump which is desirable for some applications, particularly where high pressure is desired. There are other applications in which a button actuated pump is more desirable, but button actuated pumps are typically low pressure pumps. The present invention is directed to providing a high pressure button actuated pumping system, and particularly such a high pressure pumping system which can be primed at low pressure.

SUMMARY OF THE INVENTION

The present invention provides a pumping system in which a lever is provided for operating the pumping piston of the system. The lever is actuated by a button which is movable in opposite directions to operate the lever. The lever provides a mechanical advantage so that during a given pressurizing stroke of the pumping system, the button moves farther in one direction than the pumping piston, but the lever applies high pressure to the product.

It is an object of the present invention to provide a pumping system which operates at high pressure when pumping liquid product, but which operates at very low pressure when pumping air to prime the system.

Another object of the invention is to increase the force applied to a button of the pumping system by providing a lever wholly within the confines of the pumping system for magnifying the action of the button.

A further object of the invention is to keep the pressure required to prime the pump very low so that air can be caused to escape from the pumping system at low pressures.

Other objects of this invention will appear from the following description and appended claims, reference being had to the accompanying drawings forming a part of this specification wherein like reference characters designate corresponding parts in the several views.

Figure 1:
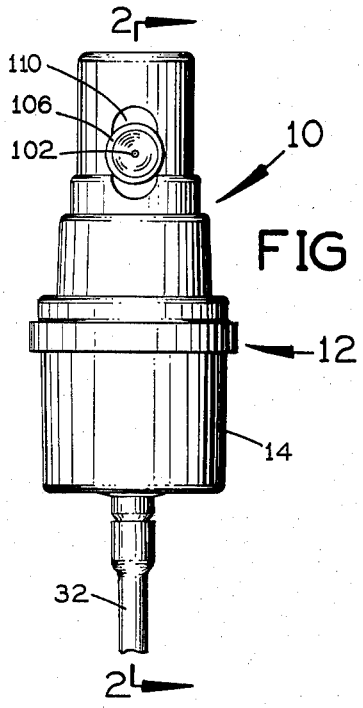
FIG. 1 is an elevational view of a pumping system in accordance with the one embodiment of the invention.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

The pumping system 10 includes a housing 12 having a mounting ring 14 as part thereof to be affixed to a container. The mounting ring 14 has internal threads 18 for engaging threads on the neck of the container. The mounting ring 14 has a lip 20 which slidably engages in a grove 22 of the shell 24 of the housing 12 so that the shell 24 can be rotated relative to the mounting ring 14. The housing 12 also includes a cylinder 26 of a piston and cylinder device generally designated 28 and also including a pumping piston 30. The piston and cylinder device 28 serves to withdraw a quantity of product from the container through a dip tube 32 on an intake stroke and to pressurize that quantity of product during a pressurizing stroke of the piston 30. The cylinder 26 serves as part of the piston and cylinder device 28 and also as part of the housing 12. The cylinder 26 has a reduced tip 34 for attachment to the dip tube 32.

The piston and cylinder device 28 also includes two check valves 36 and 38. The check valve 38 is located at the outlet of a pressurizing compartment 46 and also serves as the inlet for a storage compartment 48 which also includes an accumulator piston 50 and a cylinder 52 forming a second piston and cylinder device 52. The storage compartment 48 communicates with the check valve 38 through a space 55 inside pumping piston 30, and the piston 30 is constructed as a cylinder which may be an integral part of the cylinder 52.

The first cylinder 26 is integral with the mounting ring 14 in one piece of plastic. The check valve 38 is normally seated on a valve seat 58, but it can rise from that seat during the pressurizing stroke of the piston 30 to admit product through the space 55 into the storage compartment 48. The space 55 may be considered as an extension of the storage compartment 48. The product in the container 16 is normally a liquid and it flows past the check valve 36 into the pressurizing compartment on an intake stroke of the piston 30.

The piston 30 is actuated by a lever 60. A pivot means including tips 62 in the form of balls and a recess 64 in the housing 12 pivotally connect the left end of the lever 60 to the shell 24 (part of the housing 12) at the left side of the piston 30. It may be noted that the tips and recess could be reversed.

The lever 60 has two arms 66, and an intermediate portion 69 of the lever engages the piston 30 and the cylinder 52 for operating the piston by reciprocating movement of the lever. The lever 60 includes a tip 68 on the right side of the piston 30 to provide a portion which is actuated by a button to be described. It may be noted that the lever 60 is wholly within the shell 24 of the housing 12 and can reciprocate wholly within that housing. The tips 62 at the left end of the lever 60 are free to move horizontally back and forth in the recess 64 so that the lever can move slightly in the horizontal direction as well as reciprocating in the vertical direction. This allows the tip 68 to move up and down in a substantially vertical line.

The intermediate portion 69 of the lever 60 includes two spaced arms 66 which straddle the piston 30. The arms 66 have rounded edges at 76 and 78 which respectively engage projection 80 on piston 30 and shoulder 82 on cylinder 52 for raising and lowering the piston 30 as the lever 60 reciprocates. The tip 68 is farther from the fulcrum (tips 62) than the intermediate portion 69, so the lever provides a mechanical advantage for applying high pressure to the product. The shell 24 can be turned or rotated, and the lever 60 will rotate with it.

The lever 60 is actuated by a button 84 which is designed to be depressed manually by a finger of a person. The top surface 86 of the button 84 is pushed down by the finger. A piston portion 88 of the button 84 rides on the inside surface 90 of the shell 24 as the button 84 moves up and down. The button 84 has internal ridges 92 which guide the movement of the button, and the ridges bear against the cylinder 52 of the second piston and cylinder device.

The lower end 94 of the button 84 engages the tip 68 of the lever 60 for pushing the right end of the lever 60 down when the button 84 is pushed down. A first spring 96 biases the piston 30, and it is trapped between the projection 80 and a shoulder 98 of the cylinder 26. After the button 86 has been pushed down manually to the position shown in FIG. 6, the spring 96 returns the lever 60 and the button 84 to the upper position shown in FIG. 7.

The accumulator piston 50 has a circular resilient skirt 100 which sealingly engages the wall of the storage cylinder 52 and acts to control the flow of product to the outlet orifice 102. The accumulator piston 50 is biased downwardly by a spring 104 which has a lower end engaging the bottom of the piston 50 and an upper end engaging the inside surface of the top 86 of the button 84. The storage cylinder 52 is open at the top to enable the spring 104 to engage the button 84 at the top thereof.

Figure 3:
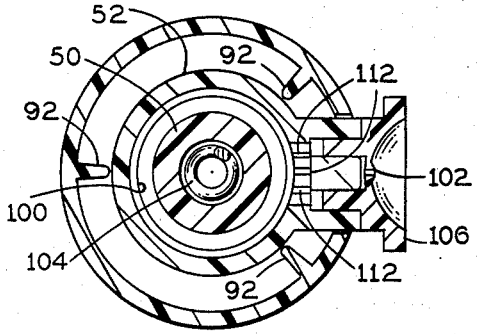
FIG. 3 is a cross-sectional view taken along line 3—3 of FIG. 2.

The restricted outlet orifice 102 is formed in a spray button 106 which is inserted in a circular projection 108 that rides in a slot 110 formed in the upper part of the button 84. The projection 108 projects outwardly from the storage cylinder 52. An outlet opening is formed by a plurality of horizontally spaced openings 112 (FIG. 3) which communicates from the storage compartment 84 through channels 114 and 116 with the restricted outlet orifice 102. The restricted outlet orifice is located at the outlet of the storage compartment and completely controls the rate of product discharge therethrough so as to allow only a portion of the pressurized product to be dispensed from the pump during the pressurizing stroke, when pumping relatively rapidly, the remainder of the product being stored in the storage compartment to be dispensed during a subsequent intake stroke of the piston 30 by contraction of the storage compartment to maintain the stream or spray from the outlet orifice when the pressurizing pump is receiving product on its intake stroke. It may be noted that the restriction of the orifice 102 may be in the channels 114 and 116 (by making them extremely small in diameter) rather than right at the orifice 102 itself.

Figure 6:
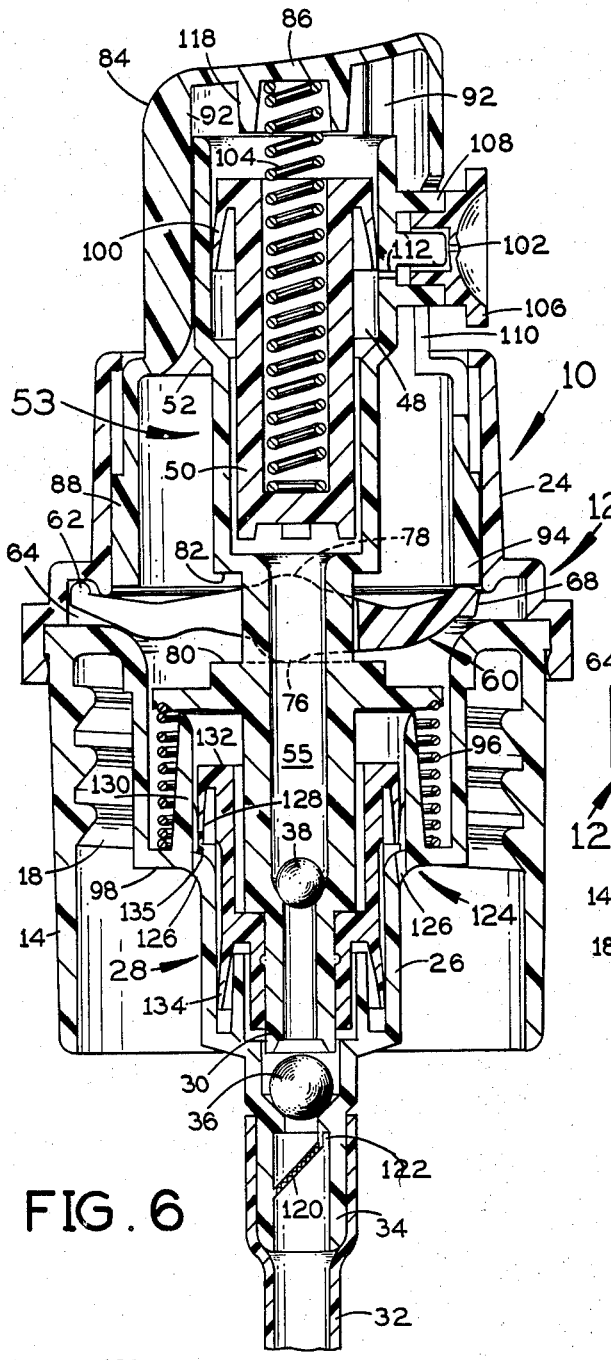
FIG. 6 is a vertical cross-sectional view similar to FIG. 2, but showing the pumping system with the button actuator in a depressed condition.
Figure 7:
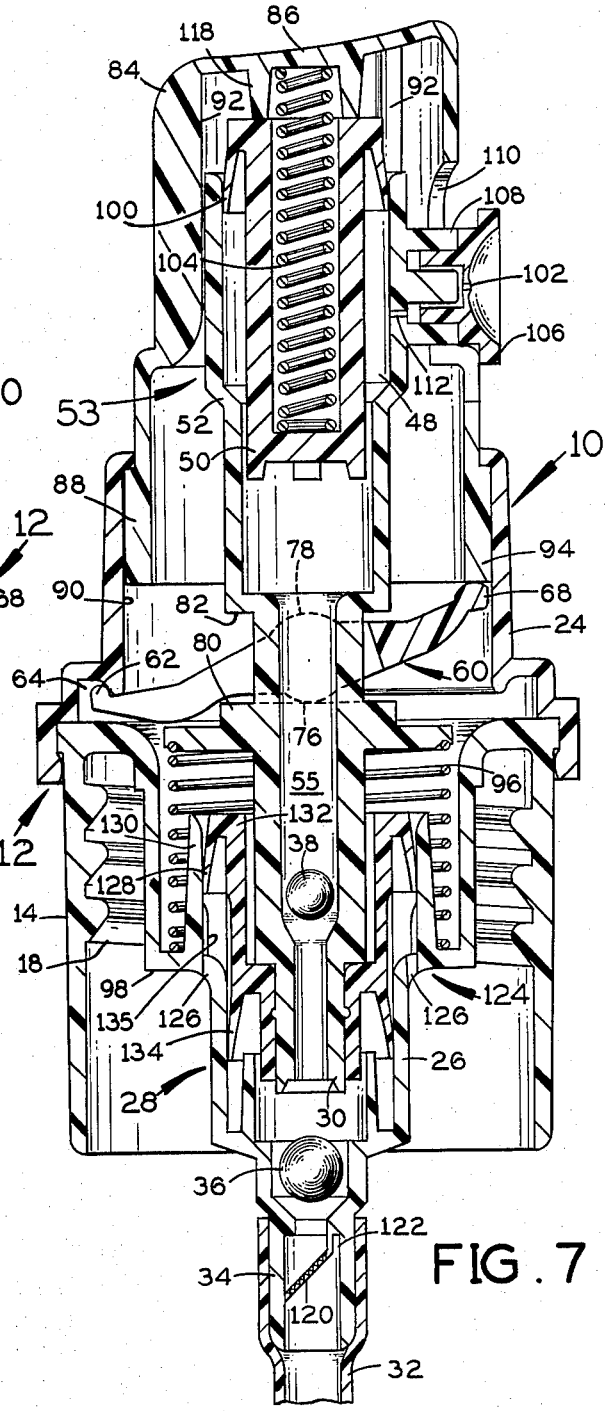
FIG. 7 is a vertical sectional view similar to FIG. 6, but showing the button actuator in a raised condition and also showing a storage piston of the device in a raised position.
Figure 5:
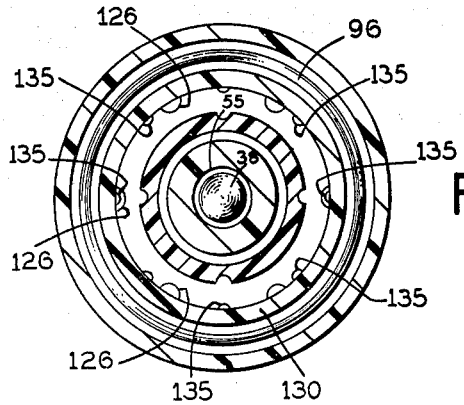
FIG. 5 is a cross-sectional view taken along line 5—5 of FIG. 2.

The action of the accumulator piston 50 is shown in FIGS. 6 and 7. After a pressurizing stroke of the lever 60, when pumping liquid product, the accumulator piston 50 is in a raised position as shown in FIG. 7. Until the accumulator piston engages the stop 118 on the inside of the button 84, the spring 104 determines the pressure under which the product is stored in the storage compartment 48. During the intake stroke of the lever 60, the accumulator piston 50 moves downwardly slightly to maintain the stream or spray issuing from the orifice 86 so that the stream or spray is relatively continuous when pumping relatively rapidly. In the rest condition of the accumulator piston 50 shown in FIG. 2, the skirt 100 of the accumulator piston encloses the outlet opening 112 to completely shut off flow of product to the restricted outlet orifice 102. The skirt 100 wipes the small outlet openings 112 to keep them clean, and the outlet openings are each individually smaller in area than the restricted orifice 102 so that they act as a filter. The total area of openings 112 is greater than that of the orifice 102.

A strainer 120 in the form of a slanting member is molded across the inside of the tip 34. It has small openings (not shown) in it, each smaller than the area of the restricted outlet orifice 102, so that they will catch particles or other foreign matter in the product flowing through the dip tube and prevent that foreign matter from clogging the outlet orifice 102. If any one of the openings in the strainer 120 become clogged, there are other openings which will act to continue the straining action. Strainer 120 cooperates with the filtering outlet openings 112 to keep the outlet orifice 102 from becoming clogged. The strainer 120 has an upper pocket 122 to catch excess foreign matter. The openings in strainer 120 are tapered with the small side down, so that the lower side of the strainer is smooth to allow particles to slide up to the pocket.

The pumping system also includes a vent means designated generally 124. The vent means includes a vent opening 126 formed in the shoulder 98 and also includes a seal 128 in the form of a circular skirt resiliently engaging the inside of a third cylinder 130 which is joined to the first cylinder 26 by the shoulder 98. The third cylinder 130 is larger in diameter than the first cylinder 26. The sealing skirt 134 acts as the main piston seal. The skirt 134 is below shoulder 98, and the other skirt 128 is above the shoulder 98.

Figure 2:
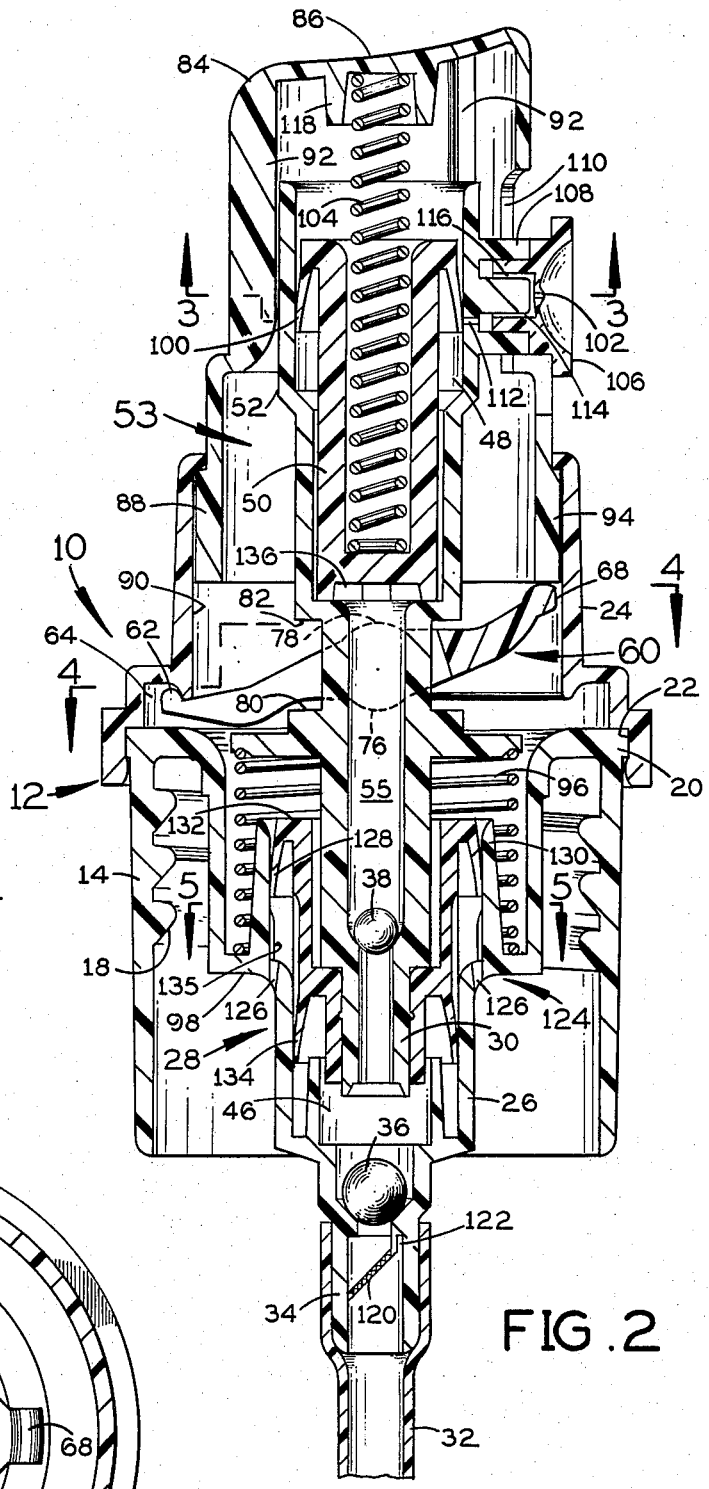
FIG. 2 is a sectional view taken along line 2—2 of FIG. 1.
Figure 4:
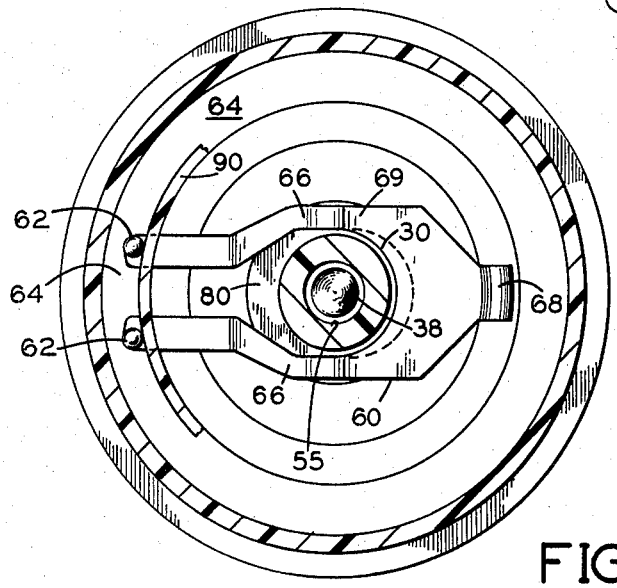
FIG. 4 is a cross-sectional view taken along line 4—4 of FIG. 2.

When the lever 60 is in its raised position as in FIG. 2, the sealing skirt 128 acts to block the vent opening 126. When the lever 60 is depressed as shown in FIG. 6, ribs 135 interrupt the seal of the skirt 128, and the interior of the container to which the pumping system is attached is vented to the atmosphere through the vent opening 126, thus allowing the pressure inside the container to equalize with atomopheric pressure. The seal of the skirt 128 could be interrupted by simply making the interior of the third cylinder 130 taper downwardly and outwardly.

The pressure between the seals 128 and 134 can never exceed the head in the container, and seal 128 prevents product from escaping when the container is shaken or squeezed. Both seals extend in the same direction.

Where the bottom of the accumulator piston 50 engages the offset or shoulder 82, slots 136 are formed in the bottom of the accumulator piston to allow product to flow past the piston.

The cylinder 26 has a very slight upward and outward taper so that pressure on the skirt 134 increases slightly as the skirt descends, and pressure on the skirt 134 is at a minimum in the rest condition of the system. Thus, the skirt 134 does not take a set.

The vent opening 126 may be molded through the shoulder 98 such that it is in the form of a partial thread having the same or lesser pitch as the threads 18 so that the mold can be unscrewed from the mounting ring. Alternatively, the vent openings 126 may be molded through the shoulder 98 by a pin on the upper mold.

The spring 104 has an important pressure controlling action. When the lever 60 is up, the spring 104 has a rest position as shown in FIG. 2. When pumping air during priming of the pump, the lever 60 goes down, and the cylinder 52 goes down to the position shown in FIG. 6. The spring 104 will tend to move down at the bottom end because the piston 30 is going down. The button 86 is going down further than the intermediate portion 69 of the lever 60 and the piston 30 because the lever has a mechanical advantage which causes the intermediate portion 69 of the lever and the piston 30 to descend a shorter distance than the travel of the button 84 and the tip 68 of the lever. The lever magnifies or amplifies the force of the button 86 so that the pressure exerted on the product is increased by the action of the lever. When the button descends when pumping air, the low pressure on the accumulator piston 50 causes the piston 50 to rise very slightly to allow the low pressure air to escape through the outlet orifice 102 as shown in FIG. 6. Then, when liquid product is being pumped, the lever and piston 30 go down to pressurize product, and the high pressure on the product raises the accumulator piston to a higher position as shown in FIG. 7.

A confining space for the spring 104 is defined by the button 84 and the piston 50. Due to the action of the button 84 and the piston 30 together with the lever 60, the confining space for the spring 104 is reduced more when pumping liquid product than when pumping air as can be seen by comparison of FIGS. 6 and 7.

Figure 8:
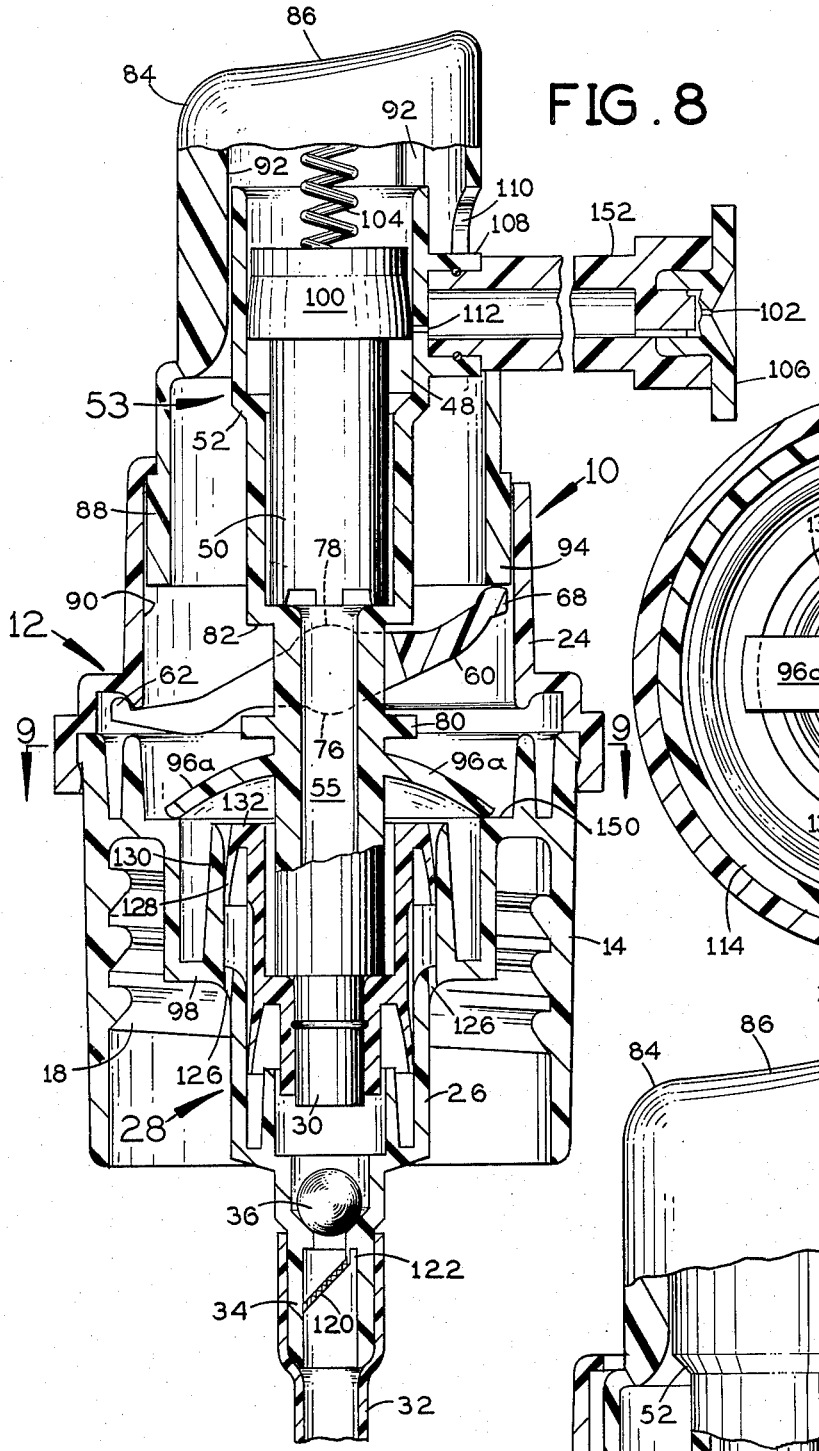
FIG. 8 is a vertical sectional view similar to FIG. 2, but showing a modified embodiment of the invention.
Figure 9:
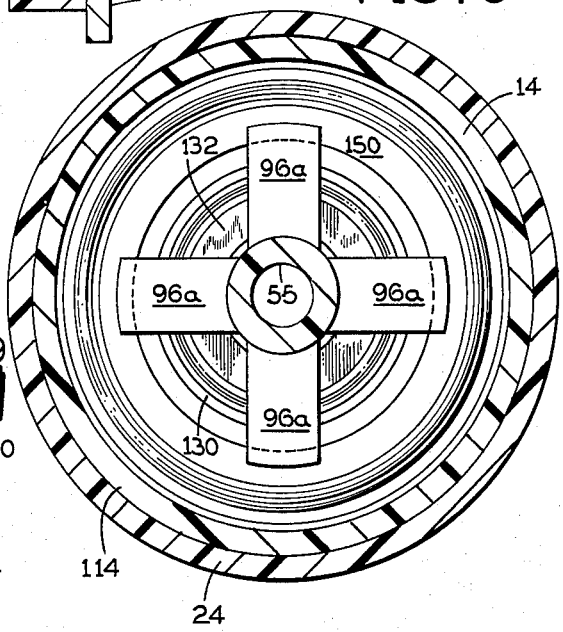
FIG. 9 is a cross-sectional view taken along line 9—9 of FIG. 8.
Figure 10:
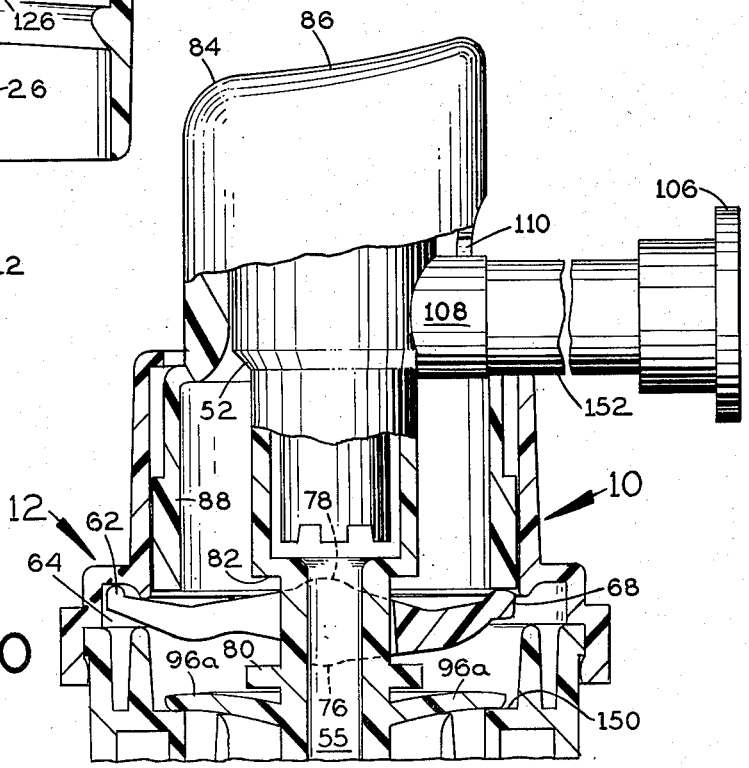
FIG. 10 is a fragmentary view, partly in section, showing the lever of FIG. 8 in a depressed position.

FIGS. 8 through 10 show a modified spring **96*a* for the first or main piston and cylinder device 28. The leaf spring 96*a* is molded integrally on the piston 30 and engages the shelf 150. In these figures, it may also be seen that there is an extension 152 for the restricted outlet orifice 102. The extension 152 snaps into the projection 108, and the spray button 106 fits into the extension 152. Such an extension 152 may be desirable where there is need to have the outlet orifice 102** extended away from the body of the pump.

The upward direction of the button's movement on an intake stroke is referred to herein as the first direction and the downward direction of the button's movement on a subsequent pressurizing stroke is referred to as the second direction because the product is first drawn into the pressurizing compartment and then is pressurized.

Having thus described our invention, we claim:

1. In a manually actuated dispenser pumping system for dispensing product from a container, comprising:

manually actuated pressurizing pump means having a pumping cylinder and a piston which moves in a first direction during an intake stroke and in an opposite second direction during a pressurizing stroke for pressurizing product withdrawn from the container by said pump means;

storage compartment means in communication with said pump means for storing pressurized product delivered from said pump means;

accumulator piston means under bias in said storage compartment means and movable by the pressure of the product to expand the capacity of said storage compartment means;

restricted orifice means in communication with said storage compartment means and restricted sufficiently to control the rate of product discharge therethrough so as to cause a portion of the product to be stored in said storage compartment during a pressurizing stroke of said piston of said pump means when pumping continuously to be discharged through said orifice on an intake stroke of said piston, said storage compartment means including an outlet opening in communication with said outlet orifice, said outlet opening being disposed relative to said second spring-loaded piston so that it is opened and closed by movement of the second spring-loaded piston thereby completely controlling the flow to the restricted orifice;

said pump means having an intake valve and an exhaust valve, said intake valve allowing the product to enter said pump means from the container, and said exhaust valve allowing the product to enter said storage compartment means;

the improvement comprising:

lever means for operating said pumping piston of said pump means, said lever means having one pivoted end;

and button means manually movable in said first and second directions to operate the other end of said lever means;

said lever means having an intermediate portion engaging said pumping piston providing a mechanical advantage so that during a given pressurizing stroke of said pumping piston said button means moves farther in said second direction than said pumping piston.

2. The pumping system as claimed in claim 1 including: leaf spring means for biasing said first piston.

3. In a pumping system for pumping product from a container in a relatively continuous stream or spray, including in combination:

a pressurizing pump including first and second check valves and a first spring-loaded piston and cylinder assembly for withdrawing a quantity of product from the container through said first check valve during an intake stroke and for pressurizing said quantity of product during a pressurizing stroke;

storage compartment means including a second spring-loaded piston and cylinder assembly expandable for storing, under a pressure determined by said second spring-loaded assembly, a quantity of pressurized product received through said second check valve from said pressurizing pump;

means defining a restricted outlet orifice in communication with said storage compartment means;

said storage compartment means being functionally located with said restricted outlet orifice at its outlet and said second check valve at its inlet from said pressurizing pump;

said storage compartment means including an outlet opening in communication with said outlet orifice, said outlet opening being disposed relative to said second spring-loaded piston so that it is opened and closed by movement of the second spring-loaded piston thereby completely controlling the flow to the restricted orifice;

the improvement comprising:

lever means having an intermediate portion engaging said first piston for moving the same in a first direction during said intake stroke and a second direction during said pressurizing stroke; said lever means having a pivoted end;

and button means engageable with the other end of said lever means and movable in said first and second directions to operate said lever means;

said lever means acting to mechanically amplify the force of said button means and reduce the movement thereof so that during a given stroke of said first piston said button means moves farther then said first piston.

4. The pumping system as claimed in claim 3 and further including:

spring means biasing said second piston;

said spring means acting between said button means and said second piston which together define a variable confining space;

said second piston being coupled for movement with said first piston so that the size of said confining space and the bias of said spring means are affected by the movement of said first piston, the size of said confining space being reduced less on a pressurizing stroke when pumping a compressible fluid such as air than when pumping liquid product.

5. The pumping system as claimed in claim 3 in which:

said lever means is movable vertically and also substantially horizontally.

6. In a manually actuated dispenser pumping system for dispensing product from a container, comprising:

manually actuated pressurizing pump means having a pumping cylinder and a piston which moves in a first direction during an intake stroke and in an opposite second direction during a pressurizing stroke for pressurizing product withdrawn from the container by said pump means;

the improvement comprising:

lever means for operating said pumping piston of said pump means; said lever means having a pivoted end;

and button means manually movable in said first and second directions to operate the other end of said lever means;

said lever means having an intermediate portion engaging said pumping piston providing a mechanical advantage so that during a given pressurizing stroke of said pumping piston said button means moves farther in said second direction than said pumping piston.

7. The pumping system as claimed in claim 6 including:

leaf spring means for biasing said first piston.

8. In a pumping system for pumping product from a container in a relatively continuous stream or spray, including in combination:

a pressurizing pump including first and second check valves and a first spring-loaded piston and cylinder assembly for withdrawing a quantity of product from the container through said first check valve during an intake stroke and for pressurizing said quantity of product during a pressurizing stroke;

the improvement comprising:

lever means having an intermediate portion engaging said first piston for moving the same in a first direction during said intake stroke and a second direction during said pressurizing stroke; said lever means having a pivoted end;

and button means engageable with the other end of said lever means and movable in said first and second directions to operate said lever means;

said lever means acting to mechanically amplify the force of said button means and reduce the movement thereof so that during a given stroke of said first piston said button means moves farther than said first piston.

9. The pumping system as claimed in claim 8 in which:

said lever means is movable vertically and also substantially horizontally.

10. In a manually actuated dispenser pumping system for dispensing product from a container, comprising:

pumping cylinder and piston means including a pumping piston which moves in a first direction during an intake stroke for withdrawing product from the container and in an opposite second direction during a pressurizing stroke for pressurizing product withdrawn from the container;

said pumping piston and cylinder means have a intake valve and an exhaust valve;

storage compartment means in communication with said pumping piston and cylinder means through said exhaust valve for storing pressurized product delivered from said pumping piston and cylinder means;

accumulator piston means under bias of spring means in said storage compartment means and movable by the pressure of the product to expand the capacity of said storage compartment means; and restricted orifice means in communication with said storage compartment means and restricted sufficiently to control the rate of product discharge therethrough so as to cause a portion of the product to be stored in said storage compartment means during a pressurizing stroke of said pumping piston to be discharged through said restricted orifice means on an intake stroke of said pumping piston;

the improvement comprising:

lever means for operating said pumping piston; said lever means having one pivoted end;

and button means manually movable in said first and second directions and engageable with the other end of said lever means to operate said lever means;

said lever means having an intermediate portion engaging said pumping piston providing a mechanical advantage so that during a given pressurizing stroke of said pumping piston said button means moves farther in said second direction than said pumping piston;

said spring means acting between said button means and said accumulator piston means which together define a variable confining space;

said accumulator piston means being coupled for movement with said pumping piston so that the size of said confining space and the bias of said spring means are affected by the movement of said pumping piston, the size of said confining space being reduced more on a pressurizing stroke when pumping liquid product than when pumping a compressed fluid such as air during priming.

11. The pumping system as claimed in claim 10 in which:

said lever means is movable horizontally as well as vertically.

12. The pumping system as claimed in claim 10 including:

leaf spring means for biasing said pumping piston.

13. The pumping system as claimed in claim 12 including:

extension means for extending said restricted orifice means.

14. The pumping system as claimed in claim 10 including:

extension means for extending said restricted orifice means.

* * * * *